US009748720B2

(12) United States Patent
Huang et al.

(10) Patent No.: US 9,748,720 B2
(45) Date of Patent: Aug. 29, 2017

(54) TRANSMISSION SHAFT SET, TRANSMISSION SHAFT STRUCTURE AND METAL PIN CONNECTING SHAFT

(71) Applicant: Acer Inc., New Taipei (TW)

(72) Inventors: Yi-Ta Huang, New Taipei (TW); Wen-Chieh Tai, New Taipei (TW); Yu-Shih Wang, New Taipei (TW); Cheng-Nan Ling, New Taipei (TW); Hsien-Wei Chen, New Taipei (TW); Chun-I Chen, New Taipei (TW)

(73) Assignee: Acer Inc., New Taipei (TW)

( * ) Notice: Subject to any disclaimer, the term of this patent is extended or adjusted under 35 U.S.C. 154(b) by 444 days.

(21) Appl. No.: 14/564,153

(22) Filed: Dec. 9, 2014

(65) Prior Publication Data

US 2016/0104991 A1 Apr. 14, 2016

(30) Foreign Application Priority Data

Oct. 8, 2014 (TW) ..... 103135118 A

(51) Int. Cl.

| | |
|---|---|
| ***H01R 39/64*** | (2006.01) |
| ***E05D 3/06*** | (2006.01) |
| ***E05D 1/06*** | (2006.01) |
| *E05D 1/04* | (2006.01) |
| *E05D 7/10* | (2006.01) |

(52) U.S. Cl.

CPC ..... *H01R 39/64* (2013.01); *E05D 1/06* (2013.01); *E05D 3/06* (2013.01); *E05D 1/04* (2013.01); *E05D 7/1055* (2013.01); *E05Y 2900/606* (2013.01)

(58) Field of Classification Search

CPC ..... E05D 3/06; E05D 1/06; E05D 11/0081; Y10T 403/32032; Y10T 403/32008; Y10T 403/32016; H01R 35/00; H01R 35/04; H01R 39/64; G06F 1/1616; G06F 1/1618; G06F 1/1681; G06F 1/1683

USPC ..... 16/366, 368, 369

See application file for complete search history.

(56) References Cited

U.S. PATENT DOCUMENTS 2,926,382 A * 3/1960 Knese ..... E05D 7/10 16/261

3,581,808 A * 6/1971 Vertesi ..... B22D 11/081 164/445

(Continued)

*Primary Examiner* — Daniel Wiley

(74) *Attorney, Agent, or Firm* — Alan D. Kamrath; Kamrath IP Lawfirm, P.A.

(57) ABSTRACT

A transmission shaft set including a plurality of transmission shaft structures is disclosed. Each transmission shaft structure includes a metal pin connecting shaft and a base. The metal pin connecting shaft includes an arc part, a fastening block, a plurality of electrically connecting parts and a plurality of electrically connecting metal pins. The plurality of electrically connecting parts are located on the arc part. The plurality of electrically connecting metal pins are located in the fastening block and electrically connected to the plurality of electrically connecting parts. The base is fastened to the metal pin connecting shaft and includes a fastening groove, at least one fastening part and at least one column. The fastening groove is used for fastening the fastening block. The fastening part is located near the fastening groove. The column is located near the fastening groove and the fastening part.

8 Claims, 5 Drawing Sheets

(56) References Cited

U.S. PATENT DOCUMENTS

| | | | | |
|---|---|---|---|---|
| 6,223,393 | B1 * | 5/2001 | Knopf | G06F 1/1681 16/366 |
| 7,214,067 | B2 * | 5/2007 | Zaderej | G06F 1/1616 439/165 |
| 8,264,823 | B2 * | 9/2012 | Kim | H04M 1/0216 345/173 |
| 8,395,893 | B2 * | 3/2013 | Harmon | G06F 1/1616 345/168 |
| 8,713,759 | B2 * | 5/2014 | Cai | G06F 1/1681 16/366 |
| 8,813,312 | B2 * | 8/2014 | Song | G06F 1/1601 16/225 |
| 2007/0117600 | A1 * | 5/2007 | Robertson, Jr. | H04M 1/0216 455/575.3 |
| 2012/0063079 | A1 * | 3/2012 | Yeh | G06F 1/1681 361/679.4 |
| 2016/0066659 | A1 * | 3/2016 | Wu | E05D 3/022 16/332 |

* cited by examiner

TRANSMISSION SHAFT SET, TRANSMISSION SHAFT STRUCTURE AND METAL PIN CONNECTING SHAFT

BACKGROUND OF THE INVENTION

1. Field of the Invention

The present invention relates to a transmission shaft set; more particularly, the present invention relates to a transmission shaft set that electronically connects the main body and the screen of a notebook computer and allows adjustment of the angle between the main body and the screen of a notebook computer, and is used for connecting an electronic device.

2. Description of the Related Art

In modern life, the notebook computer can be carried and used conveniently anywhere by the user; therefore, the notebook computer is popular with consumers. In the current notebook computer structure, the main body and the screen of the notebook computer are connected via a rotating axis and a cable, allowing the screen and main body to transfer electronic signals to each other, and the screen can rotate relative to the main body to perform the act of closing or opening.

However, the design and assembly of the rotating axis and the cable entail certain production costs; in addition, the design of the rotating axis and the cable of the prior art limit the rotation angle of the screen, such that the screen can only rotate on one side of the main body of the computer, and the angle cannot be changed to satisfy all user requirements.

Therefore, there is a need to provide a new connecting axis which provides both electronic connection and adjustable angles.

SUMMARY OF THE INVENTION

It is an object of the present invention to provide a transmission shaft set that has the features of providing electronic connection and adjustment of the angle between a main body and a screen of a notebook computer and that is used for connecting the main body and the screen of a notebook computer.

To achieve the abovementioned object, the transmission shaft set of the present invention includes a plurality of transmission shaft structures. Each of the transmission shaft structures includes a metal pin connecting shaft and a base. The metal pin connecting shaft includes an arc part, a fastening block, a plurality of electrically connecting parts and a plurality of electrically connecting metal pins. The plurality of electrically connecting parts are located on the arc part. The plurality of electrically connecting metal pins are located on the fastening block and are electrically connected to the plurality of electrically connecting parts. The base is fastened to the metal pin connecting shaft, and the base includes a fastening groove, at least one fastening part and at least one column. The fastening groove is used for fastening to the fastening block. The at least one fastening part is located next to the fastening groove. The at least one column is located next to the fastening groove and the at least one fastening part. The at least one fastening part of the base of any transmission shaft structure is fastened to the at least one column of the base of another transmission shaft structure, whereby the plurality of transmission shaft structures are connected to each other.

According to one embodiment of the present invention, the electrically connecting metal pin of the metal pin connecting shaft of any transmission shaft structure contacts and electrically connects to the electrically connecting metal pin of the metal pin connecting shaft of another transmission shaft structure, whereby the plurality of transmission shaft structures are electrically connected to each other.

According to one embodiment of the present invention, the metal pin connecting shaft further includes a plurality of elastic parts, and the plurality of elastic parts are respectively connected to a plurality of electrically connecting metal pins.

According to one embodiment of the present invention, the metal pin connecting shaft further includes a plurality of holes, and the positions of the plurality of holes are respectively corresponded to the plurality of electrically connecting metal pins; via the elastic force of the plurality of elastic parts, the plurality of electrically connecting metal pins pass through the plurality of corresponding holes.

According to one embodiment of the present invention, the range of a central angle of the arc part is between 1 and 359 degrees.

It is another object of the present invention to provide a transmission shaft structure that includes a metal pin connecting shaft and a base. The metal pin connecting shaft includes an arc part, a fastening block, a plurality of electrically connecting parts and a plurality of electrically connecting metal pins. The plurality of electrically connecting parts are located on the arc part. The plurality of electrically connecting metal pins are located on the fastening block and are electrically connected to the plurality of electrically connecting parts. The base is fastened to the metal pin connecting shaft. The base includes a fastening groove, at least one fastening part, and at least one column. The fastening groove is used for fastening the fastening block. The at least one fastening part is located next to the fastening groove. The at least one column is located next to the fastening groove and the at least one fastening part.

It is another object of the present invention to provide a metal pin connecting shaft for fastening to a base, wherein the base includes a fastening groove. The metal pin connecting shaft includes an arc part, a fastening block, a plurality of electrically connecting parts and a plurality of electrically connecting metal pins. The fastening block is used for fastening to the fastening groove. The plurality of electrically connecting parts are located on the arc part. The plurality of electrically connecting metal pins are located on the fastening block and electrically connect to the plurality of electrically connecting parts.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
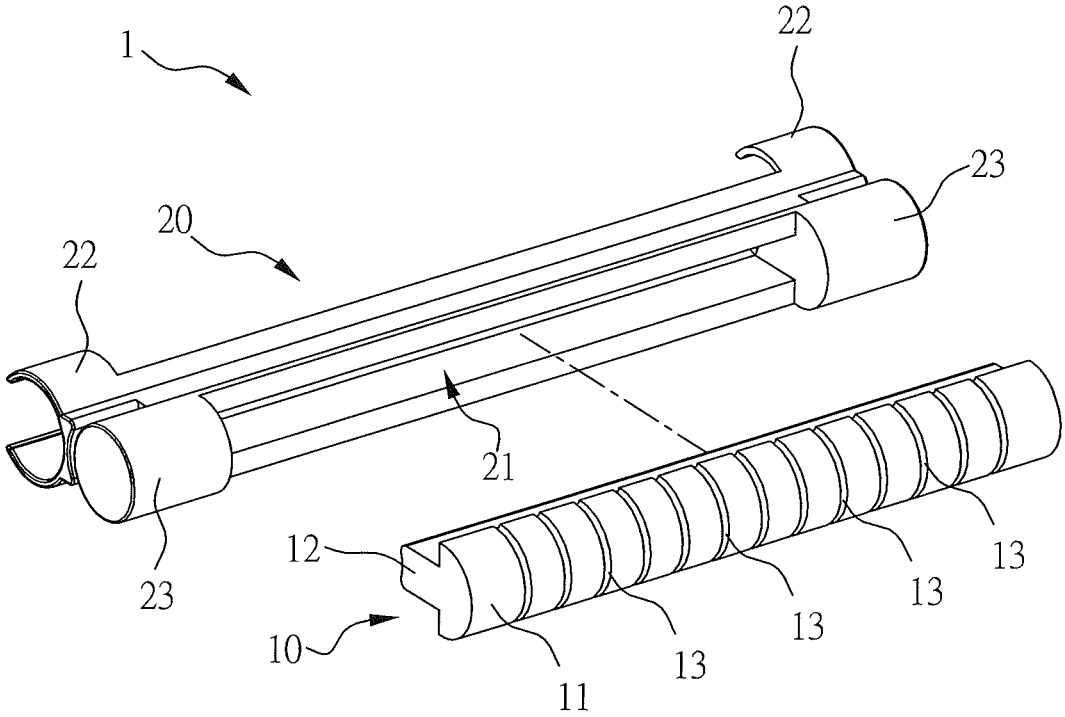
FIG. 1 illustrates a schematic drawing of the separating metal pin connecting shaft and the base of the transmission shaft structure of one embodiment of the present invention.
Figure 2:
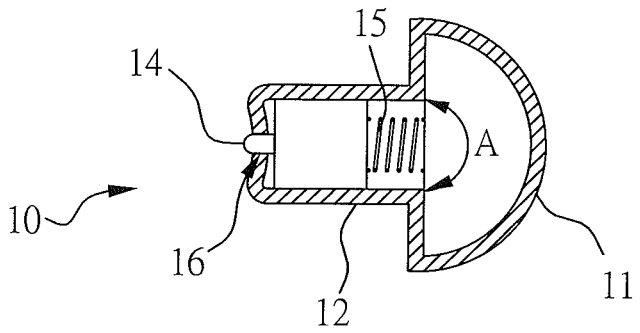
FIG. 2 illustrates a cross-sectional drawing of the metal pin connecting shaft of one embodiment of the present invention.
Figure 3:
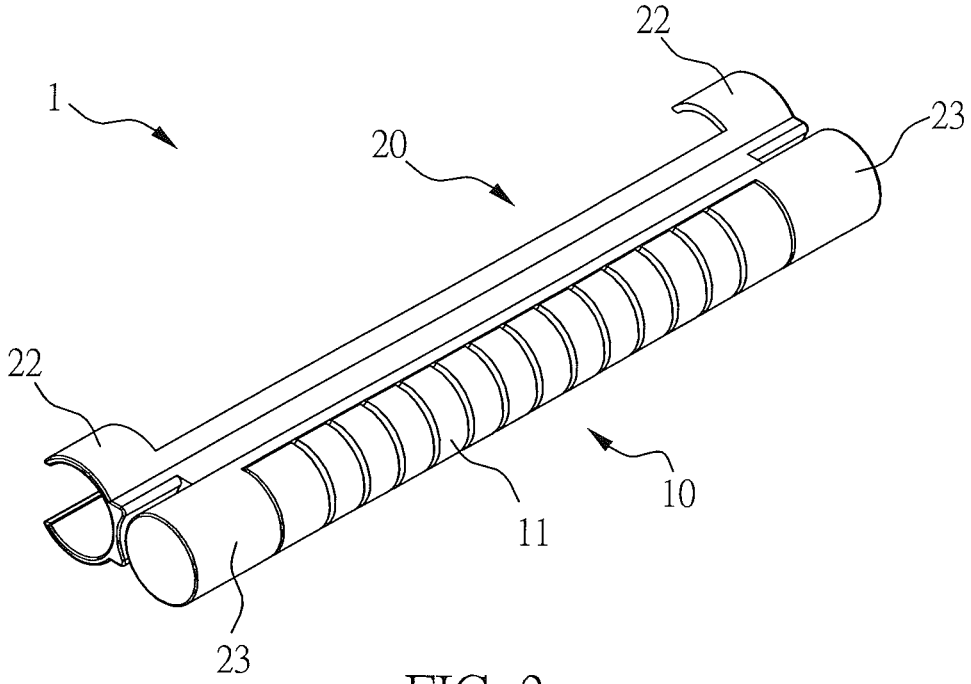
FIG. 3 illustrates a schematic drawing of the combining metal pin connecting shaft and the base of the transmission shaft structure of one embodiment of the present invention.
Figure 4:
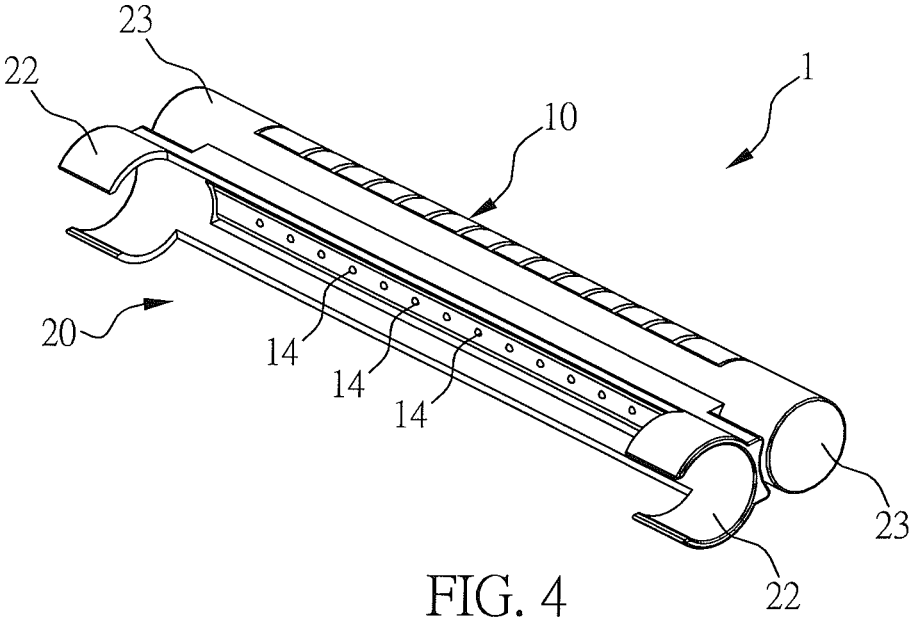
FIG. 4 illustrates a schematic drawing of the combining metal pin connecting shaft and the base of the transmission shaft structure of one embodiment of the present invention.
Figure 5:
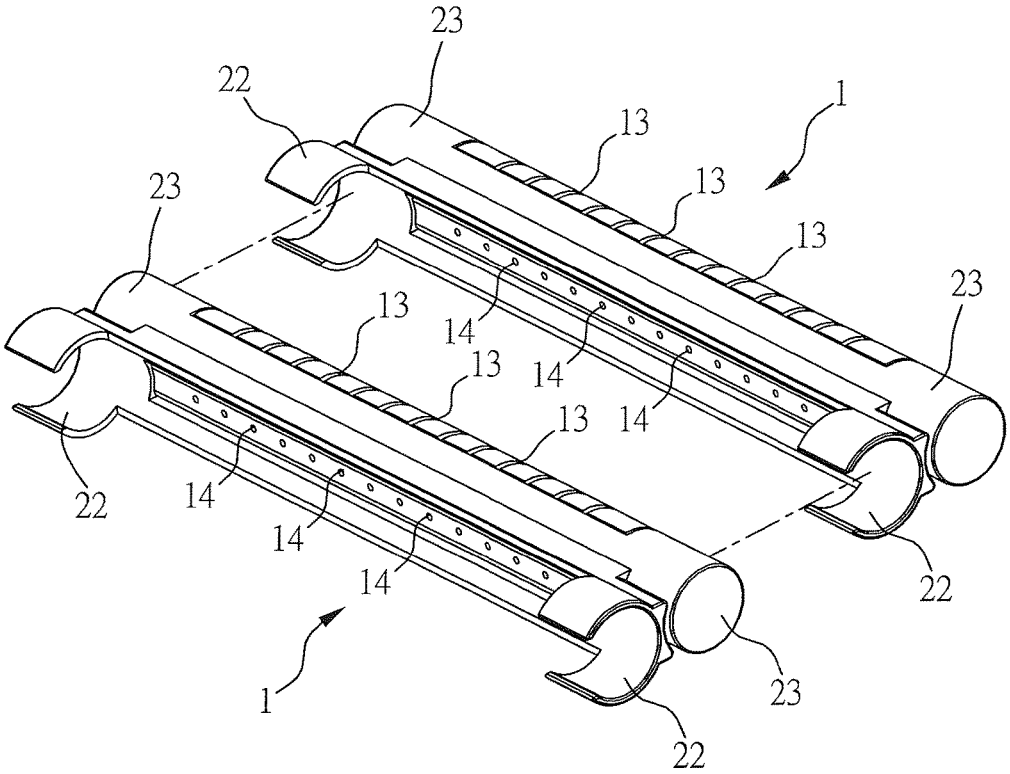
FIG. 5 illustrates a schematic drawing of the separating transmission shaft structure of one embodiment of the present invention.
Figure 6:
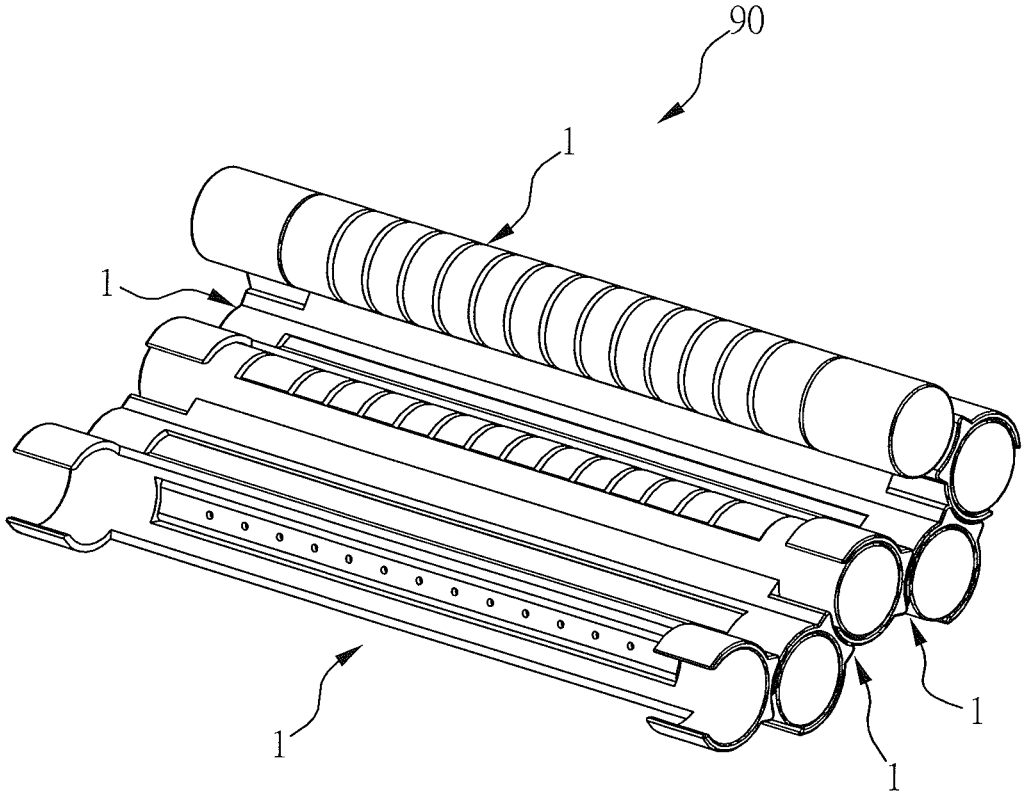
FIG. 6 illustrates a schematic drawing of the transmission shaft set of one embodiment of the present invention.
Figure 7:
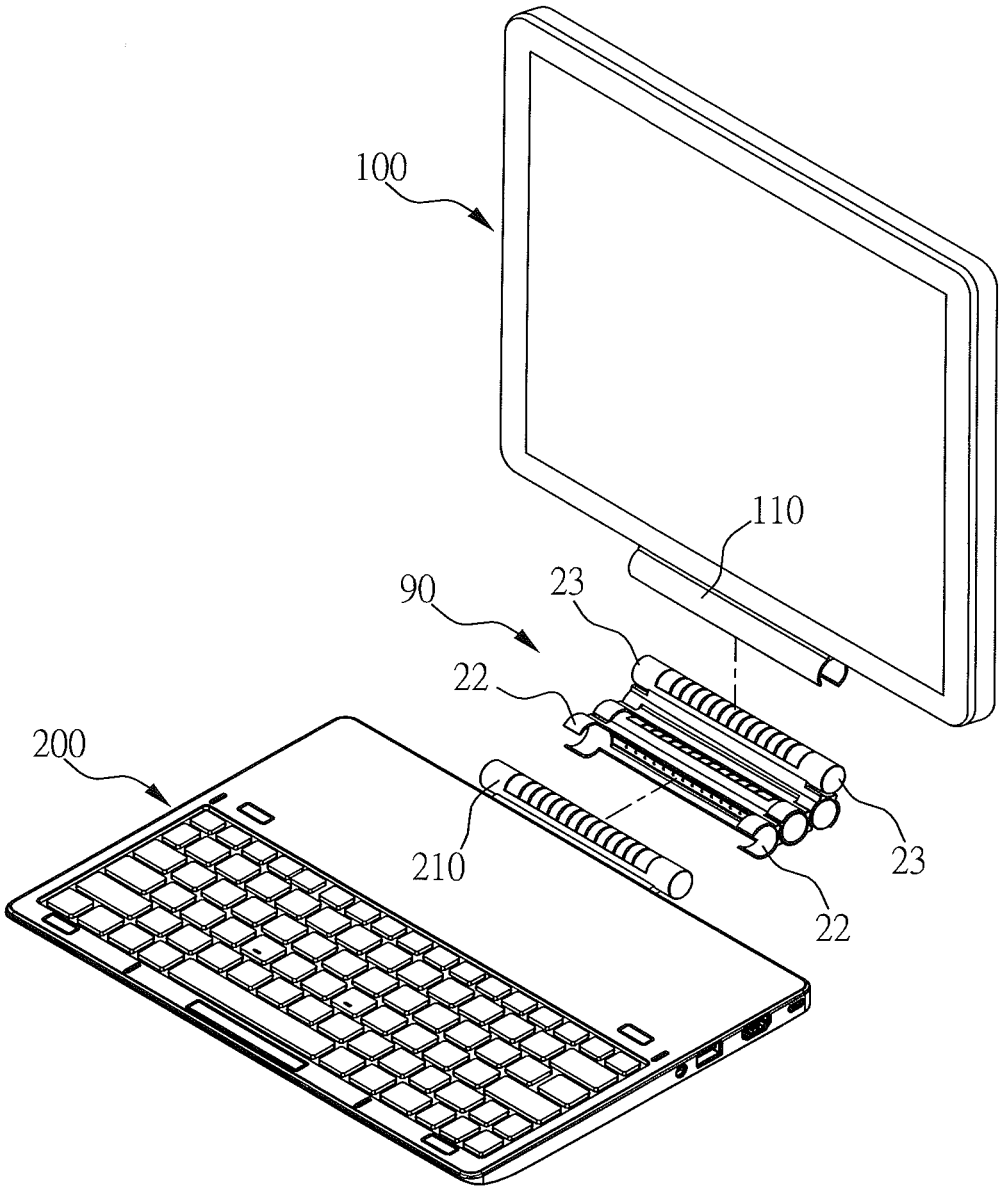
FIG. 7 illustrates a schematic drawing of the first electronic device, the second electronic device, and the transmission shaft set of one embodiment of the present invention.

Please refer to FIG. 1 to FIG. 7, which illustrate the transmission shaft set, the transmission shaft structure and the metal pin connecting shaft according to one embodiment of the present invention. FIG. 1 illustrates a schematic drawing of the separating metal pin connecting shaft and the base of the transmission shaft structure of one embodiment of the present invention. FIG. 2 illustrates a cross-sectional drawing of the metal pin connecting shaft of one embodiment of the present invention. FIG. 3 illustrates a schematic drawing of the combining metal pin connecting shaft and the base of the transmission shaft structure of one embodiment of the present invention. FIG. 4 illustrates a schematic drawing of the combining metal pin connecting shaft and the base of the transmission shaft structure of one embodiment of the present invention. FIG. 5 illustrates a schematic drawing of the separating transmission shaft structure of one embodiment of the present invention. FIG. 6 illustrates a schematic drawing of the transmission shaft set of one embodiment of the present invention. FIG. 7 illustrates a schematic drawing of the first electronic device, the second electronic device, and the transmission shaft set of one embodiment of the present invention.

As shown in FIG. 1, FIG. 2 and FIG. 4, in one embodiment of the present invention, the transmission shaft structure 1 includes a metal pin connecting shaft 10 and a base 20. The metal pin connecting shaft 10 includes an arc part 11, a fastening block 12, a plurality of electrically connecting parts 13, a plurality of electrically connecting metal pins 14, a plurality of elastic parts 15, and a plurality of holes 16. In one embodiment, the electrically connecting metal pin 14 can be a pogo pin, but the present invention is not limited to that design. A central angle A of the arc part 11 of the present embodiment is 180 degrees, but the angle of the central angle A is not limited to that design; it can be any angle between 1 and 359 degrees according to the design requirement. The fastening block 12 is used for fastening to the base 20. The plurality of electrically connecting parts 13 are located on the arc part 11, and the electrically connecting parts 13 are metal bars which are arc shaped. The electrically connecting parts 13 are used for transferring the electronic signal. The plurality of electrically connecting metal pins 14 are located on the fastening block 12 and are electrically connected to the plurality of electrically connecting parts 13. The electrically connecting metal pins 14 are used for transferring the electronic signal. The plurality of elastic parts 15 are springs, and the plurality of elastic parts 15 are respectively connected to the plurality of electrically connecting metal pins 14. The positions of the plurality of holes 16 are respectively corresponded to the plurality of electrically connecting metal pins 14. Via the elastic force of the plurality of elastic parts 15, the plurality of electrically connecting metal pins 14 can be respectively pushed to pass through the corresponding holes 16.

In one embodiment of the present invention, the base 20 is used for fastening to the metal pin connecting shaft 10, and the base 20 includes a fastening groove 21, two fastening parts 22, and two columns 23; however, the numbers of the fastening parts 22 and the columns 23 are not limited to the abovementioned description. The shape of the fastening groove 21 is corresponded to the fastening block 12, and the fastening groove 21 is used for fastening to the fastening block 12. Two fastening parts 22 are arc-shaped clips and are located next to the fastening groove 21. Two columns 23 are located next to the fastening groove 21 and are respectively located next to the two fastening parts 22. As shown in FIG. 5, the fastening part 22 of the base 20 of each transmission shaft structure 1 is used for fastening to the column 23 of the base 20 of another transmission shaft structure 1, whereby the plurality of transmission shaft structures 1 can be connected to each other. Because the fastening part 22 is an arc-shaped clip with an arc structure and the column 23 has a corresponding cylindrical appearance, then when the fastening part 22 and the column 23 are fastened to each other, the user can rotate the fastening part 22 or the column 23 according to the user's requirements to adjust the fastening angle between the fastening part 22 and the column 23.

As shown in FIG. 2 to FIG. 4, in one embodiment of the present invention, when the fastening groove 21 is fastened to the fastening block 12, the metal pin connecting shaft 10 will be combined with the base 20, and the electrically connecting metal pins 14 will pass through the holes 16 and be exposed from the fastening groove 21. As shown in FIG. 5 to FIG. 6, when the metal pin connecting shaft 10 of the transmission shaft structure 1 and the base 20 are combined, the fastening part 22 of the base 20 of each transmission shaft structure 1 can be further fastened to the column 23 of the base 20 of another transmission shaft structure 1; at this moment, the electrically connecting metal pin 14 of the metal pin connecting shaft 10 of each transmission shaft structure 1 is pushed by the elastic part 15 to project to the outside and thereby to contact and electrically connect to the electrically connecting part 13 of the metal pin connecting shaft 10 of another transmission shaft structure 1, whereby the plurality of transmission shaft structures 1 are electrically connected to each other. In addition, because the electrically connecting part 13 has an arc-shaped surface, when the user rotates the fastening part 22 or the column 23, the electrically connecting metal pin 14 can maintain contact with the arc-shaped surface of the electrically connecting part 13, such that the electrical connection between the electrically connecting metal pin 14 and the electrically connecting part 13 will not be broken.

As shown in FIG. 5 to FIG. 7, when the plurality of transmission shaft structures 1 are combined, the plurality of transmission shaft structures 1 will form a transmission shaft set 90. Via adjustment of the fastening angle of the fastening part 22 of the base 20 of each transmission shaft structure 1 and the column 23 of the base 20 of each transmission shaft structure 1, the transmission shaft set 90 can present many various display angles; therefore, the transmission shaft set 90 of the present invention can be used for combining a first electronic device 100 and a second electronic device 200. The first electronic device 100 of the present invention is a screen, which has a corresponding fastening structure 110. The corresponding fastening structure 110 is used for fastening the two columns 23 of the transmission shaft set 90 and is used for electrically connecting to the plurality of electrically connecting parts 13. The second electronic device 200 is a computer main body of a notebook computer, which has a corresponding column 210. The corresponding column 210 is used for fastening to the two fastening parts 22 of the transmission shaft set 90 and is used for electrically connecting to the plurality of electrically connecting metal pins 14. When the transmission shaft set 90 is fastened to the corresponding fastening structure 110 of the first electronic device 100 and the corresponding column 210 of the second electronic device 200, the first electronic device 100 and the second electronic device 200 can be combined; at this moment, via the electrical connection between the corresponding fastening structure 110 and the electrically connecting part 13 and the electrical connection between the corresponding column 210 and the electrically connecting metal pin 14, the first electronic device 100 and the second electronic device 200 can be electrically connected to each other. However, the types of the first electronic device 100 and the second electronic device 200 are not limited to the computer main body of a notebook computer and a keyboard and can be other kinds of electronic devices.

When the user wants to use the transmission shaft set 90 of the present invention to combine the first electronic device 100 and the second electronic device 200, as shown in FIG. 1 and FIG. 3, the user can fasten the fastening block 12 of the metal pin connecting shaft 10 to the fastening groove 21 of the base 20, allowing the metal pin connecting shaft 10 to combine with the base 20. Then, as shown in FIG. 5 and FIG. 6, the user can use the fastening part 22 of the base 20 of any transmission shaft structure 1 to fasten the column 23 of the base 20 of another transmission shaft structure 1, allowing the plurality of transmission shaft structures 1 to connect to each other to form the transmission shaft set 90. Then, as shown in FIG. 7, the user can use two fastening parts 22 of the transmission shaft set 90 to fasten the corresponding column 210 of the second electronic device 200, after which the user can use the two columns 23 of the transmission shaft set 90 to fasten to the corresponding fastening structure 110 of the first electronic device 100. Therefore, the first electronic device 100 and second electronic device 200 can be combined with each other. In addition, the first electronic device 100 and the second electronic device 200 can be electrically connected via the electrically connecting feature of the transmission shaft set 90. If the user needs to adjust the relative combining angle between the first electronic device 100 and the second electronic device 200, the user can adjust the fastening angle between the fastening part 22 and the column 23 of any two transmission shaft structures 1 of the transmission shaft set 90 to change the relative combining angle between the first electronic device 100 and the second electronic device 200.

Via the design of the transmission shaft set 90 and the transmission shaft structure 1 of the present invention, the transmission shaft set 90 provides variable adjusting angles and the feature of electrical connection. In addition, the transmission shaft set 90 of the present invention can be used for quickly combining two electronic devices such that the two electronic devices are electrically connected with each other.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the present invention.

What is claimed is:

1. A transmission shaft structure, comprising:
- a metal pin connecting shaft, comprising:
  - an arc part;
  - a fastening block;
  - a plurality of electrically connecting parts located on the arc part;
  - a plurality of electrically connecting metal pins located on the fastening block and electrically connected to the plurality of electrically connecting parts; and
  - a plurality of elastic parts respectively connected to the plurality of electrically connecting metal pins, wherein the elastic parts bias the electrically connecting pins out of the fastening block; and
- a base fastened to the metal pin connecting shaft, the base comprising:
  - a fastening groove, used for fastening to the fastening block;
  - at least one fastening part located next to the fastening groove; and
  - at least one column located next to the fastening groove and the at least one fastening part.

2. The transmission shaft structure as claimed in claim 1, wherein the metal pin connecting shaft further comprises a plurality of holes, the locations of the plurality of holes corresponding to the plurality of electrically connecting metal pins; via an elastic force of the plurality of elastic parts, the plurality of electrically connecting metal pins pass through the plurality of corresponding holes.

3. The transmission shaft structure as claimed in claim 2, wherein a range of a central angle of the arc part is between 1 and 359 degrees.

4. A transmission shaft set, comprising:
- a plurality of transmission shaft structures, each of the transmission shaft structures comprising:
  - a metal pin connecting shaft, comprising:
    - an arc part;
    - a fastening block;
    - a plurality of electrically connecting parts located on the arc part; and
    - a plurality of electrically connecting metal pins located on the fastening block and electrically connected to the plurality of electrically connecting parts; and
  - a base fastened to the metal pin connecting shaft, the base comprising:
    - a fastening groove, used for fastening to the fastening block;
    - at least one fastening part located next to the fastening groove; and
    - at least one column located next to the fastening groove and the fastening part;
  - wherein the at least one fastening part of the base of one of the transmission shaft structures is fastened to the at least one column of the base of another transmission shaft structure, whereby the plurality of transmission shaft structures are connected to each other.

5. The transmission shaft set as claimed in claim 4, wherein the electrically connecting metal pin of the metal pin connecting shaft of one of the transmission shaft structures contacts and electrically connects to the electrically connecting part of the metal pin connecting shaft of another transmission shaft structure, whereby the plurality of transmission shaft structures are electrically connected to each other.

6. The transmission shaft set as claimed in claim 5, wherein the metal pin connecting shaft further comprises a plurality of elastic parts and the plurality of elastic parts are respectively connected to the plurality of electrically connecting metal pins.

7. The transmission shaft set as claimed in claim 6, wherein the metal pin connecting shaft further comprises a plurality of holes, the locations of the plurality of holes corresponding to the plurality of electrically connecting metal pins; via an elastic force of the plurality of elastic parts, the plurality of electrically connecting metal pins pass through the plurality of corresponding holes.

8. The transmission shaft set as claimed in claim 7, wherein a range of a central angle of the arc part is between 1 and 359 degrees.

* * * * *